US011385029B1

(12) United States Patent
Abboud

(10) Patent No.: US 11,385,029 B1
(45) Date of Patent: Jul. 12, 2022

(54) SAFETY GUARD FOR CONDUCTIVE ENERGY WEAPON AMMUNITION AND RELATED METHODS

(71) Applicant: Leonidas IP, LLC, Charleston (KN)

(72) Inventor: Steven Abboud, Davenport, FL (US)

(73) Assignee: Leonidas IP, LLC, Charleston (KN)

( * ) Notice: Subject to any disclaimer, the term of this patent is extended or adjusted under 35 U.S.C. 154(b) by 156 days.

(21) Appl. No.: 16/984,063

(22) Filed: Aug. 3, 2020

Related U.S. Application Data

(62) Division of application No. 14/632,958, filed on Feb. 26, 2015, now Pat. No. 10,731,952.

(51) Int. Cl.

| | |
|---|---|
| ***F41B 15/04*** | (2006.01) |
| ***H01T 23/00*** | (2006.01) |
| ***F41H 13/00*** | (2006.01) |
| ***F41H 1/00*** | (2006.01) |

(52) U.S. Cl.
CPC ..... *F41H 13/0018* (2013.01); *F41H 1/00* (2013.01); *F41H 13/0025* (2013.01)

(58) Field of Classification Search
CPC ..... F41H 1/00; F41H 13/0018; F41H 13/0025
USPC ..... 361/232
See application file for complete search history.

(56) References Cited

U.S. PATENT DOCUMENTS

| | | | | |
|---|---|---|---|---|
| 3,803,463 | A | 4/1974 | Cover | |
| 3,929,286 | A | 12/1975 | Hastings | |
| 5,078,117 | A | 1/1992 | Cover | |
| 5,184,278 | A * | 2/1993 | Jordan | H02B 1/42 361/627 |
| 5,388,603 | A | 2/1995 | Bauer | |
| 5,786,546 | A | 7/1998 | Simson | |
| 5,996,503 | A | 12/1999 | Woodall et al. | |
| 7,075,770 | B1 | 7/2006 | Smith | |
| 7,305,787 | B1 | 12/2007 | Stratbucker | |
| 7,600,337 | B2 | 10/2009 | Nerheim et al. | |
| 7,673,411 | B1 | 3/2010 | Baldwin | |
| 7,676,972 | B2 | 3/2010 | Smith et al. | |
| 7,859,818 | B2 | 12/2010 | Kroll et al. | |

(Continued)

OTHER PUBLICATIONS

Raysun X-1 Product Description by Defenders Network, Inc., accessed at least as early as Dec. 21, 2012, available at http://www.defend-net.com/raysun/index.options.html.

(Continued)

*Primary Examiner* — Jared Fureman
*Assistant Examiner* — Lucy M Thomas
(74) *Attorney, Agent, or Firm* — Adam R. Stephenson, Ltd.

(57) ABSTRACT

A safety guard for an ammunition cartridge (cartridge) of a conductive energy weapon (CEW) includes a body having a first electrical contact on a first side of the body and a second electrical contact on a second side of the body opposite the first side of the body. The first and second electrical contacts are in electrical communication with each other through the body. The first and second electrical contacts are configured to contact a first electrode of the cartridge and a second electrode of the cartridge, respectively, when the body is placed over the cartridge. The safety guard is configured to prevent the cartridge from firing when a firing input, such as a trigger pull, is received by the CEW from a user. In implementations the body includes at least one clip having a projection configured to be inserted in a corresponding depression of the cartridge of the CEW.

20 Claims, 4 Drawing Sheets

(56) References Cited

U.S. PATENT DOCUMENTS

| | | | |
|---|---|---|---|
| 7,944,676 | B2 | 5/2011 | Smith et al. |
| 8,045,316 | B2 | 10/2011 | Nerheim |
| 8,320,098 | B2 | 11/2012 | Klug et al. |
| 8,733,251 | B1 | 5/2014 | Abboud et al. |
| 8,934,213 | B2 | 1/2015 | Froom |
| 9,939,219 | B1 | 4/2018 | Ulbrich |
| 2006/0187610 | A1 | 8/2006 | Su |
| 2008/0276822 | A1 | 11/2008 | Lubbers et al. |
| 2009/0229484 | A1 | 9/2009 | Flynn |
| 2010/0146835 | A1 | 6/2010 | Mc Nulty, Jr. |
| 2010/0315755 | A1 | 12/2010 | Gavin |
| 2011/0168748 | A1 | 7/2011 | Benes |
| 2013/0123051 | A1 | 5/2013 | Pierce |
| 2013/0279065 | A1 | 10/2013 | Froom |
| 2016/0131548 | A1 | 5/2016 | Brucker |

OTHER PUBLICATIONS

Raysun XI Multi-Mode Police Weapon Product Description by Defenders Network, Inc., published online at least as early as Dec. 21, 2012, available online at http://www.defend-net.com/raysun/index.html, last visited Feb. 19, 2015.

Raysun XI Multi-Mode Police Weapon Catalog Page by Defenders Network, Inc., published online at least as early as Dec. 21, 2012, available online at http://www.defend-net.com/raysun/Images/Raysun%20X1%20print.pdf, last visited Feb. 19, 2015.

Raysun XI Non-Lethal Police Weapon Operations Manual by Defenders Network, Inc., published at least as early as 2009, available at http://www.defend-net.com/raysun/Images/Raysun%20Instr.%20outside.pdf.

Raysun X-I Product Advertisement on May 1, 2009 internet archive of www.JiunAn.com website, available at http://web.archive.org/web/20090501084907/http://www.jiunan.com.tw/en/defense/stungun-x1.html.

* cited by examiner

SAFETY GUARD FOR CONDUCTIVE ENERGY WEAPON AMMUNITION AND RELATED METHODS

CROSS REFERENCE TO RELATED APPLICATIONS

This application is a divisional application of the earlier U.S. Utility Patent Application to Steven Abboud entitled "Safety Guard for Conductive Energy Weapon Ammunition and Related Methods," application Ser. No. 14/632,958, filed Feb. 26, 2015, now pending, the disclosure of which is hereby incorporated entirely herein by reference.

BACKGROUND

1. Technical Field

Aspects of this document relate generally to conductive energy devices (CEDs), also known as conductive energy weapons (CEWs), and to ammunition for the same.

2. Background Art

Conductive energy weapons (CEWs) are weapons that fire projectiles to administer an electrical shock to a target or that otherwise administer an electrical shock to a target. Ammunition for CEWs include cartridges that may be inserted into a cavity of a CEW and then removed after fired or in order to replace the cartridge with a different cartridge. Cartridges may have a pair of exposed electrodes so that, in the case wherein a target is not immobilized by a projectile of the CEW and/or when the target is in close proximity with a user firing the CEW, an electrical shock may be administered to the target by pulling a trigger of the CEW while the electrodes are in close proximity with the target, such as pressed up against the target's clothing or exposed skin.

SUMMARY

Implementations of safety guards for ammunition cartridges (cartridges) of conductive energy weapons (CEWs) may include: a body including: a first electrical contact on a first side of the body; a second electrical contact on a second side of the body opposite the first side of the body, the second electrical contact in electrical communication with the first electrical contact through the body, and; at least one clip having a projection configured to be inserted in a corresponding depression of an ammunition cartridge (cartridge) of a conductive energy weapon (CEW); wherein the first electrical contact and the second electrical contact are configured to contact a first electrode of the cartridge and a second electrode of the cartridge, respectively, when the body is placed over the ammunition cartridge.

Implementations of safety guards for ammunition cartridges (cartridges) of conductive energy weapons (CEWs) may include one, all, or any of the following:

The at least one clip may include a first clip having a first projection and a second clip having a second projection, the first projection configured to be inserted in a corresponding first depression of the cartridge and the second projection configured to be inserted in a corresponding second depression of the cartridge.

The at least one clip may be located between the first electrical contact and the second electrical contact.

The first electrical contact and the second electrical contact may each include a curved tab extending substantially perpendicularly from a largest planar surface of a top panel of the body.

The projection may include a tab extending substantially perpendicularly from a largest planar surface of a side panel of the body.

An electrical insulator may be coupled at a top of the body and may be configured to prevent an electrical current from passing between the first electrode and the second electrode through a target when the target is coupled with the first electrode and the second electrode only through the electrical insulator.

The first electrical contact may apply a pressure to the first electrode and the second electrical contact may apply a pressure to the second electrode sufficient to retain the body coupled with the cartridge.

The pressure applied to the first electrode and the pressure applied to the second electrode may be configured to be overcome through manual force alone of a user to remove the body from the cartridge.

The safety guard may be configured to prevent the cartridge from firing due to a static charge.

The safety guard may be configured to prevent the cartridge from firing when the cartridge is inserted into the CEW and a firing input is received by the CEW from a user.

A majority of the safety guard may be formed of an electrically conductive material.

Implementations of safety guards for ammunition cartridges (cartridges) of conductive energy weapons (CEWs) may include: a body removably coupled with an ammunition cartridge (cartridge), the body including: a first biased retainer having a first electrical contact on a first side of the body in electrical contact with a first electrode of the cartridge; a second biased retainer having a second electrical contact on a second side of the body opposite the first side of the body, the second electrical contact in electrical communication with the first electrical contact through the body, and the second electrical contact in electrical contact with a second electrode of the cartridge, and; at least one clip having a projection configured to be inserted into a corresponding depression of the cartridge.

Implementations of safety guards for ammunition cartridges (cartridges) of conductive energy weapons (CEWs) may include one, all, or any of the following:

A bias of the first biased retainer and a bias of the second biased retainer may be configured to be overcome through manual force alone of a user to remove the body from the cartridge.

The body may be configured to prevent a static charge from firing the cartridge when the first electrical contact is in contact with the first electrode and the second electrical contact is in contact with the second electrode.

The body may be configured to prevent a trigger pull of the CEW from discharging a projectile from the cartridge when the first electrical contact is contacting the first electrode and the second electrical contact is contacting the second electrode.

The body may be configured to prevent a trigger pull of the CEW from igniting a squib of the cartridge when the first electrical contact is contacting the first electrode and the second electrical contact is contacting the second electrode.

An electrical insulator may be coupled at a top of the body and may be configured to prevent an electrical current from passing between the first electrode and the second electrode through a target when the target is coupled with the first electrode and the second electrode only through the electrical insulator.

Implementations of safety systems for conductive energy weapons (CEWs) may include: a conductive energy weapon (CEW); an ammunition cartridge (cartridge) coupled with the CEW, and; a safety guard coupled with the cartridge and including an electrically conductive material, the safety guard electrically coupling a first electrode of the cartridge with a second electrode of the cartridge; wherein the safety guard is configured to prevent the cartridge from firing when a firing input is received by the CEW from a user.

Implementations of safety systems for conductive energy weapons (CEWs) may include one, all, or any of the following:

An electrical insulator may be coupled with the safety guard and may be configured to prevent an electrical current from passing between the first electrode and the second electrode through a target when the target is coupled with the first electrode and the second electrode only through the electrical insulator.

The safety guard may be configured to prevent a static charge from firing the cartridge.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended safety guards for conductive energy weapon ammunition and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such safety guards for conductive energy weapon ammunition and related methods and implementing components and methods, consistent with the intended operation and methods.

Figure 6:
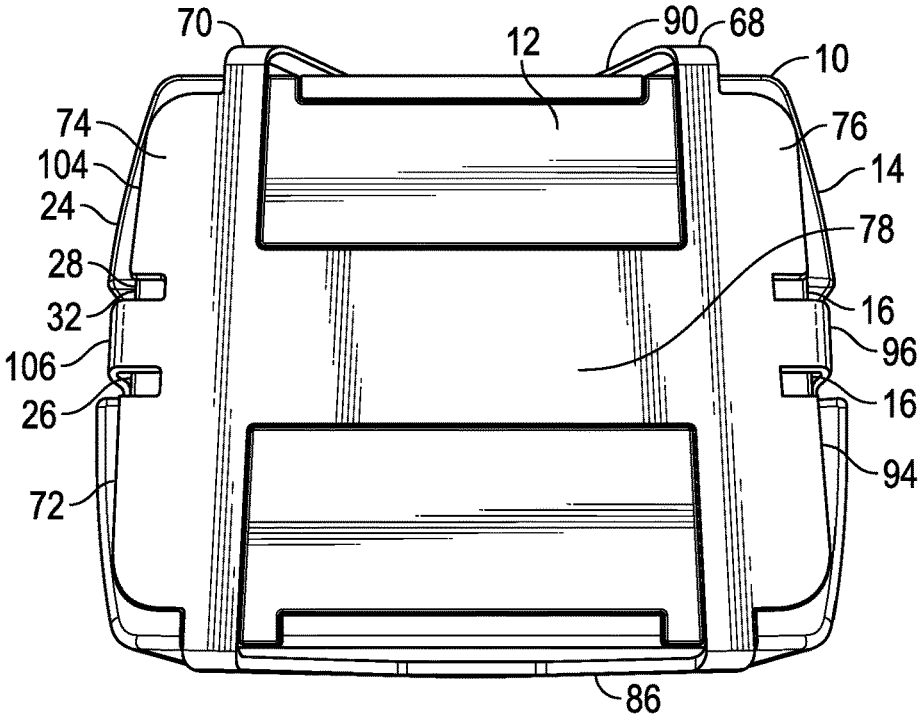
FIG. 6 is a top view of the safety guard and cartridge of FIG. 4.
Figure 7:
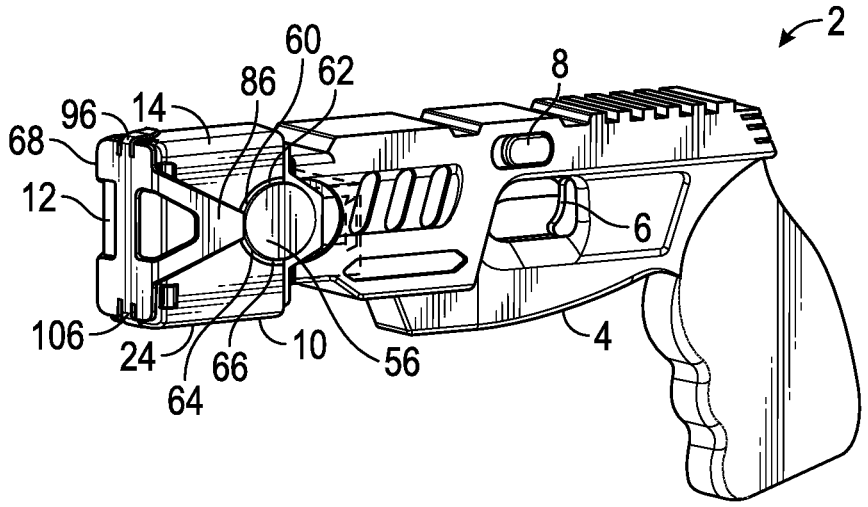
FIG. 7 is a side perspective partial see-through view of a safety system including the safety guard and cartridge of FIG. 4 and a conductive energy weapon (CEW)
Figure 8:
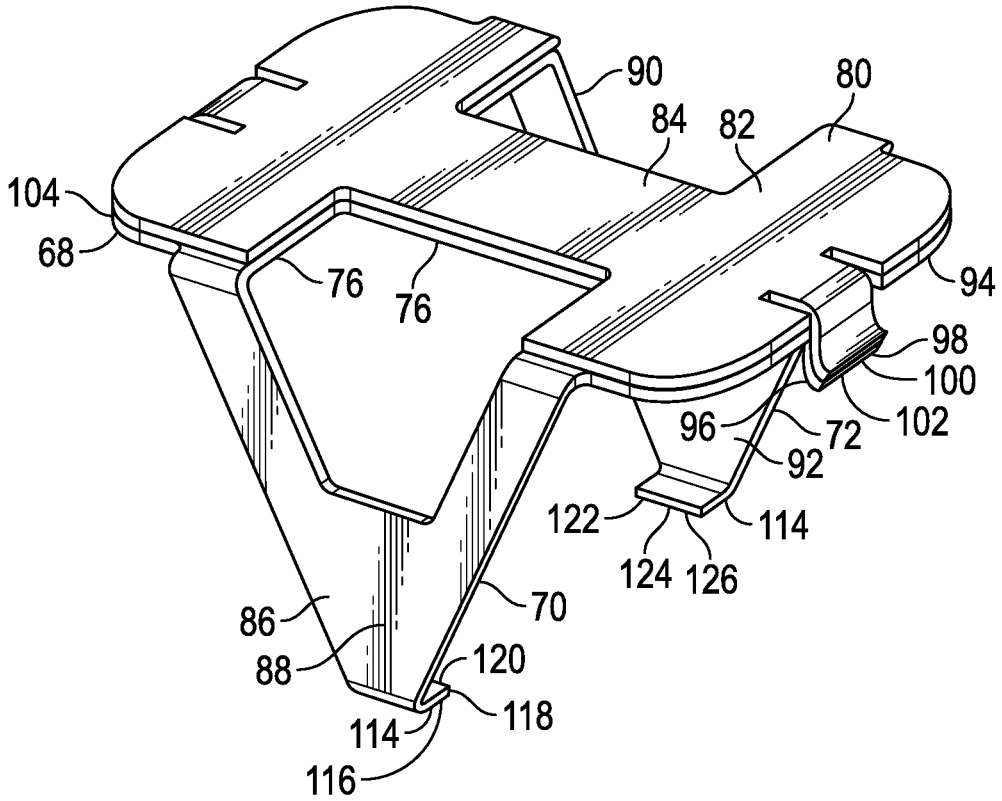
FIG. 8 is a perspective view of the safety guard of FIG. 1 with an electrical insulator coupled with a top of a body of the safety guard.

Referring now to FIGS. 1-8, in various implementations, a safety guard 68 for an ammunition cartridge (cartridge) 10 of a conductive energy weapon (CEW) 4 is formed of an electrically conductive material 70. In implementations the entire safety guard 68 is formed of an electrically conductive material 70, though in other implementations less than an entirety of the safety guard could be formed of an electrically conductive material, so long as a first electrical contact 96 and second electrical contact 106 are electrically coupled together with an electrically conductive material and are themselves electrically conductive so as to be able to electrically couple a first electrode 18 of the cartridge with a second electrode 28 of the cartridge. For example, a majority of the safety guard could be formed of a non-conductive material, such as a polymer or composite material, with the first electrical contact and second electrical contact formed of metal and electrically coupled together through a metal strip or wire coupled in, or on, a body 72 of the safety guard. In other implementations a majority of the safety guard may be formed of an electrically conductive material. In other implementations, as shown in FIG. 8, an entire body 72 of the safety guard may be formed of an electrically conductive metal, and an electrical insulator 80, which may form an insulative layer 82 or an insulative coating 84, may be coupled at a top 74 of the body 72, as will be described hereafter.

Figure 1:
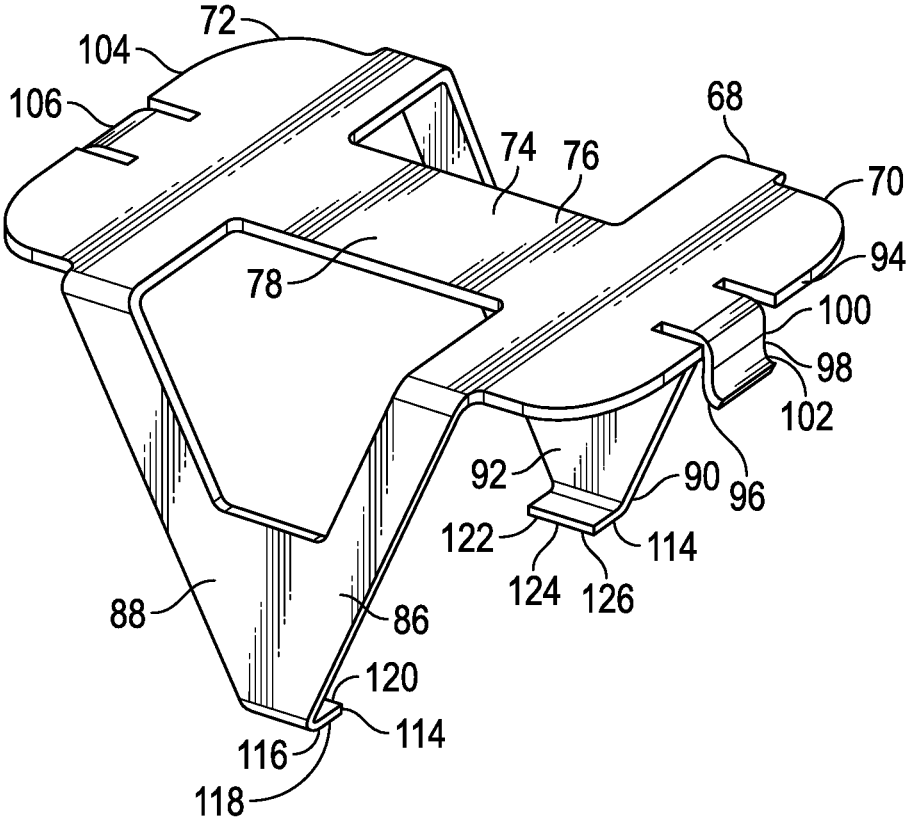
FIG. 1 is a perspective view of an implementation of a safety guard.
Figure 2:
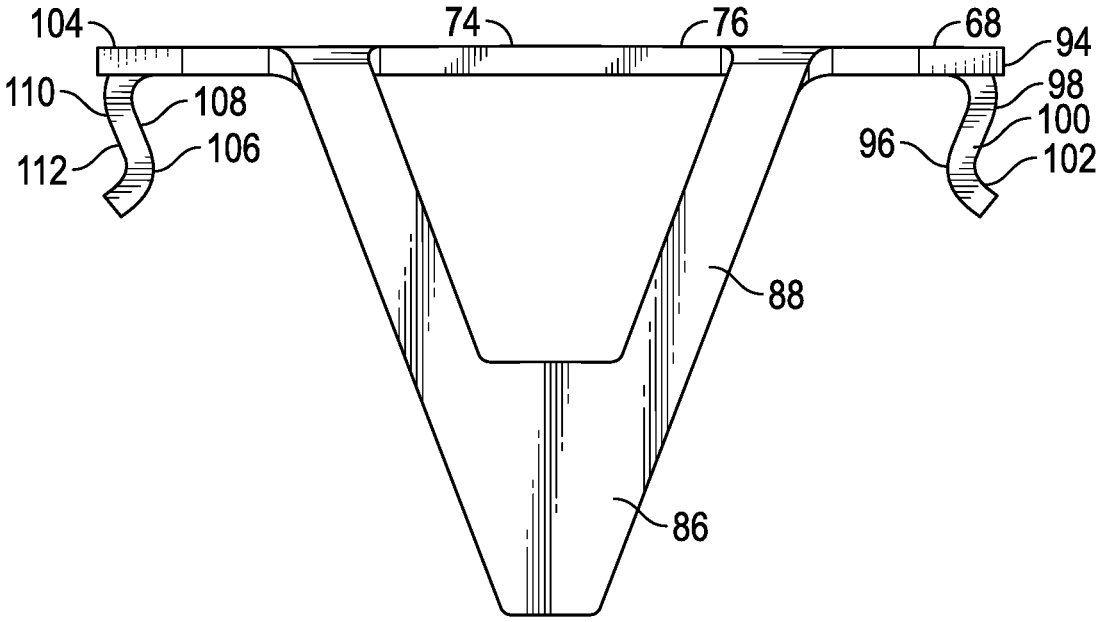
FIG. 2 is a side view of the safety guard of FIG. 1.

Referring now to FIG. 1, safety guard 68 includes a body 72 having a top 74. A top panel 76 includes a largest planar surface 78. The largest planar surface 78 shown in FIG. 1 is on an upper side (outer side or outside) of the top panel, but there is also a largest planar surface on the underside (inner side or inside) of the top panel that is the same or substantially the same size as the largest planar surface on the top of the top panel and that is parallel or substantially parallel therewith. A first side panel 86 extends downward perpendicularly, or substantially perpendicularly, from the top panel 76, and includes a largest planar surface 88. Only one side of the first side panel 86 is shown in FIG. 1 (the outer or outside), but both sides of the first side panel 86 (the outer or outside and the inner or inside) include a largest planar surface and the two largest planar surfaces are the same, or substantially the same, size, and are parallel or substantially parallel with each other. A second side panel 90 extends downward perpendicularly, or substantially perpendicularly, from the top panel 76, and includes a largest planar surface 92. Only one side (the inner or inside) of the second side panel 90 is shown in FIG. 1, but both sides (the inner or inside and the outer or outside) of the second side panel 90 include a largest planar surface and the two largest planar surfaces are the same, or substantially the same, size and are parallel or substantially parallel with each other. The first side panel 86 and second side panel 90 are substantially parallel, or are parallel, with one another, as can be seen from FIG. 3 (which also shows the perpendicularity, or substantial perpendicularity, of the first side panel and second side panel relative to the top panel).

In other implementations, the side panels could be positioned so that they are not parallel with one another, or not substantially parallel with respect to one another, or so that either or both are not substantially perpendicular, or not perpendicular, relative to the top panel. Nevertheless, the aforementioned perpendicularity of the first side panel and second side panel relative to the top panel and their parallelism relative to one another helps them to fit snugly over a cartridge 10 for a CEW 4 that generally has the shape of a cuboid, as seen in FIGS. 4-7. This may allow the CEW 4 to be holstered and/or otherwise stored in a compact manner even when the safety guard is in place and coupled with the ammunition cartridge.

Referring still to FIGS. 1-8, the body 72 includes a first side 94 and a second side 104 on an opposite side of the body from the first side 94. The first electrical contact 96 is located at the first side 94 and the second electrical contact 106 is located at the second side 104. The first electrical contact 96 is a tab 98 which extends downwards or substantially downwards, or, in other words, substantially perpendicularly away from the largest planar surface of the top panel 76 downwards in the same direction that the first side panel 86 and second side panel 90 extend away from the top panel 76. The tab 98 is a curved tab 100 and forms a first biased retainer 102. The second electrical contact 106 is a tab 108 which also extends downwards or substantially downwards, or, in other words, substantially perpendicularly away from the largest planar surface of the top panel 76 downwards in the same directions that the first side panel 86 and second side panel 90 extend away from the top panel 76. The tab 108 is a curved tab 110 and forms a second biased retainer 112.

The first biased retainer 102 and second biased retainer 112 cooperate to secure the safety guard 68 to a cartridge. Referring to FIGS. 4-7, when the safety guard is placed over a cartridge 10, such that the top panel 76 of the body 72 comes into contact or at least on close proximity with a top 12 of the ammunition cartridge, the first biased retainer 102 and second biased retainer 112 are placed into contact with the first electrode 18 and second electrode 28, respectively, so that the first electrical contact 96 is in electrical contact with the first electrode 18 and the second electrical contact 106 is in electrical contact with the second electrode 28. At the same time, the first biased retainer 102 and the second biased retainer 112, due to their curvature and/or their distance from one another, are positioned such that each applies an inward pressure towards its corresponding electrode when safety guard 68 is in place over the cartridge. Thus the first biased retainer applies a pressure against the first electrode 18 and the second biased retainer applies a pressure against the second electrode 28. This pressure is sufficient to keep the safety guard 68 in place, clipped onto the cartridge, and in implementations it may also assist in forming a good electrical contact between the first electrical contact and the first electrode and the second electrical contact and the second electrode, respectively.

Figure 5:
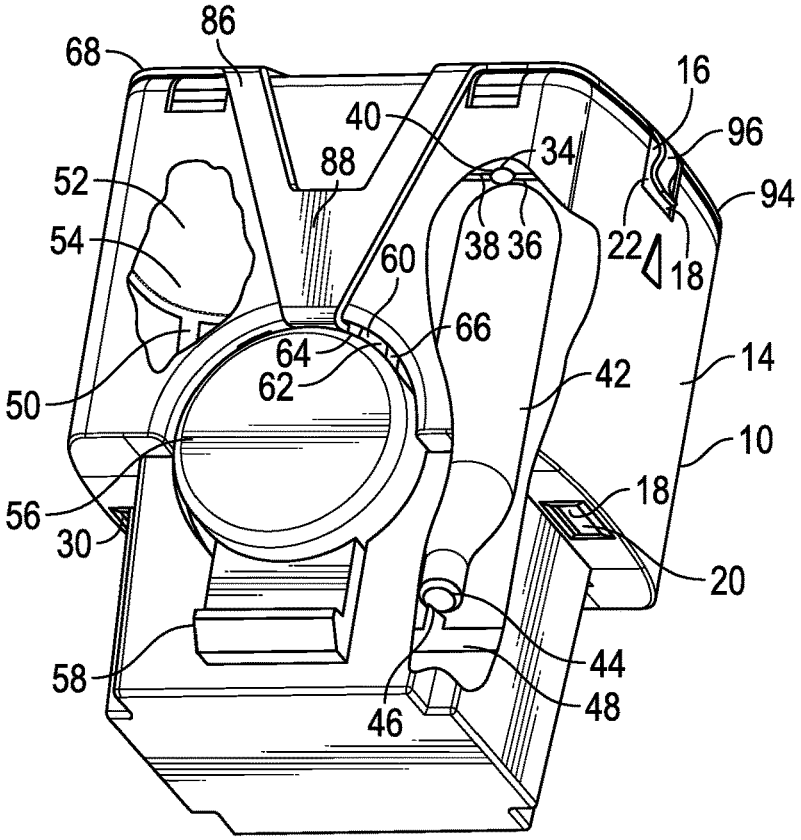
FIG. 5 is a front perspective partial see-through view of the safety guard and cartridge of FIG. 4.

Referring to FIG. 5, the first electrode 18 includes a top contact 22 and a bottom contact 20. The top contact 22 is visible proximate the top 12 of the cartridge and the bottom contact 20 is visible further down. The first electrical contact 96 contacts the first electrode at the top contact 22. The second electrode 28 similarly has a top contact 32 proximate the top 12 of the cartridge and the bottom contact 30 is visible further down. The second electrical contact 106 contacts the second electrode at the top contact 32. The top contact 22 and bottom contact 20 are in electrical communication with one another. Though not visible in the drawings, a single conductive element, which is a metallic element, forms both the top contact 22 and bottom contact 20. The top contact 32 and bottom contact 30 similarly are in electrical communication with one another. Though not visible in the drawings, a single conductive element, which is a metallic element, forms both the top contact 32 and bottom contact 30.

In implementations the top contact 22 and bottom contact 20 are formed by a flat metallic element that is at least partially enclosed or encased within a side surface 14 of the cartridge so that only the top contact and bottom contact of the flat metallic element are exposed through the cartridge. Likewise, in implementations the top contact 32 and bottom contact 30 are formed by a second flat metallic element that is at least partially enclosed or encased within a side surface 24 of the cartridge so that only the top contact and bottom contact of the second flat metallic element are exposed through the cartridge. In FIG. 5 it may be seen that the first electrode 18 is exposed through the side surface 14 at a recess 16 in the cartridge. Likewise, as seen in FIG. 6, the second electrode 28 is exposed through the side surface 24 at a recess 26 in the cartridge. When the safety guard is placed over the cartridge, as shown in FIG. 5, the first electrical contact 96 and second electrical contact 106 slide over the first electrode and second electrode, respectively, and therefore reside at least partially within the recesses 16 and 26, respectively.

Referring to FIG. 7, in use the cartridge is coupled with a conductive energy weapon (CEW) 4. The CEW 4 includes a first conductor and a second conductor that, when the cartridge is coupled with the CEW, are in electrical contact with the bottom contacts 20 and 30 of the first electrode and second electrode, respectively, of the cartridge. The CEW is configured so that, when a firing input is received by the CEW, such as a trigger pull, a voltage or potential is applied across the first conductor and second conductor. In implementations the firing input is a trigger pull of a trigger 6 though, in implementations, the firing input could include the pressing of a button or some other interaction of the user with the CEW.

In normal operation, when a voltage is applied across the first conductor and second conductor of the CEW, this forms a voltage across the first electrode and second electrode of cartridge 10 and, accordingly, causes the cartridge to fire one or more projectiles. For example, referring to FIG. 5, in implementations the first electrode of the cartridge is in electrical communication with a first lead 36 of a squib 34 and the second electrode of the cartridge is in electrical communication with a second lead 38 of the squib. The squib includes an explosive 40 that is ignited when the voltage is applied across the first electrode and second electrode.

When the squib ignites, a lower end 44 of a propellant container 42 is moved towards a piercing member 46, which pierces the lower end of the propellant container and causes the propellant container to emit its contents, which in this case includes a compressed gas, into a chamber 48 in fluid communication with the piercing member. The piercing member in implementations has a shape of an angled cylindrical hollow element in fluid communication with a hollow element forming chamber 48. Chamber 48 is in fluid communication with chamber 50, which is proximate a projectile 52. In the implementation shown the projectile is a pepper ball 54. Thus, when the compressed gas or other propellant expands into the chamber 50 from chamber 48 it propels the projectile towards the top 12 of the cartridge. The projectile in implementations then impacts the top of the cartridge, causing the top of the cartridge to open and/or be jettisoned, and exits the cartridge towards a target. In other implementations the top 12 of the cartridge is opened and/or jettisoned earlier, such as from pressure from the explosion of the squib, so that when the projectile is propelled by the expanding gas it exits the cartridge but never comes into contact with the top 12 of the cartridge.

The above firing sequence is given only as a representative example. Although an explosive squib, a compressed gas container, and a pepper ball are used in this example, other elements could be used in other cartridges. The pepper ball is, naturally, not in electrical communication with the cartridge when it exits the cartridge, but in other implementations darts could be used that are in electrical communication with the cartridge after exiting therefrom, such as with conductive wires that are coupled with the first and second electrodes of the cartridge. The cartridge may thus flow a current through a target, between the first and second electrodes, through the darts, to immobilize the target. Other projectiles could be used, such as one or more paint balls, pepper powder, one or more rubber bullets, a non-electrified dart, and so forth. Any combination of different types of projectiles could be used, as well—for instance a first trigger pull could fire a first projectile (or pair of projectiles) and a second trigger pull could fire a second projectile (or pair of projectiles), and so forth.

After the cartridge has been fired, when the trigger 6 is pulled or some other firing input is received by the CEW there is a potential across the first electrode and second electrode of the cartridge, and this may be used to cause a current to flow through a target. For instance if a target (such as a person or animal) is not immobilized sufficiently through the use of one or more projectiles that are fired from the cartridge, and the cartridge then has no more projectiles to fire, the user firing the CEW may attempt to contact the cartridge with the target, such as by placing the top contacts 22 and 32 of the first electrode and second electrode, respectively, against the skin or clothing of the target or in close proximity therewith, while communicating a firing input to the CEW such as by pulling the trigger 6. Because there is a voltage across the first electrode and second electrode in this instance, despite the cartridge already having been "fired," a current will then flow between the first and second electrode, through the target, and this may be used to immobilize the target.

CEW 4 includes a safety 8 which, when activated, will prevent the firing input (such as a trigger pull) from causing a voltage to be applied across the first conductor and second conductor of the CEW and/or which may prevent a trigger from being depressed. This will in turn prevent the cartridge from being fired and will also prevent a voltage from being applied across the first and second electrodes of the cartridge. Such a safety mechanism may prevent accidental firings of the cartridge and/or accidental electrical shocking of a person or target.

The safety guard 68 alters the customary operation of the CEW and cartridge. When the cartridge is inserted into the CEW and the safety guard is in place, as shown in FIG. 7, then when the trigger pulled or another firing input is received by the CEW, a voltage is applied across the first conductor and second conductor of the CEW, and therefore across the first electrode and second electrode of the cartridge, but because the first electrical contact and second electrical contact are in electrical communication with the first and second electrodes, respectively, and are in electrical communication with one another, there is insufficient voltage across the first lead and second lead of the squib in order to fire the squib. In implementations this may be due to the relative resistance of the paths across the squib and across the safety guard, respectively. Because the safety guard may include a low resistance, conductive metal coupling the first electrical contact with the second electrical contact, then when the trigger is pulled current flows between the first electrical contact and second electrical contact through the top panel 76 of the body 72 so that there is insufficient current and/or voltage across the leads of the squib to fire the squib. The safety guard thus serves as a safety mechanism that prevents the cartridge from firing a projectile even when the safety of the CEW is not activated and even when the trigger is pulled or another firing input is received by the CEW.

The safety guard may also prevent accidental or unintentional firing (misfiring) of the cartridge due to static electricity, or due to a static charge. If a sufficient static charge is applied across the first electrode and second electrode of the cartridge, then the cartridge may misfire. This could occur when the CEW is holstered or when a user is otherwise not attempting to fire it, and may cause injury or immobilization to the user or a non-target person or animal, and/or may cause damage to the CEW, the cartridge, and/or other nearby items. Thus, when the safety guard is in place, a static charge if applied across the first electrode and second electrode will cause a current to flow between the first electrical contact and second electrical contact through the body of the safety guard, and thus there will not be enough current through the squib to cause the squib to fire.

A misfiring may also be caused by an accidental trigger pull or other accidental firing input to the CEW. For example when a user is attempting to remove the CEW from a holster, if the safety is not activated and the user accidentally pulls the trigger or otherwise communicates a firing input to the CEW, the CEW will misfire, potentially causing injury or immobilization to the user or a non-target person or animal, and/or damage to the CEW, the cartridge, and/or other nearby items. If the safety guard is in place over the cartridge, however, such an accidental trigger pull will not cause the cartridge to fire, even if the safety is not activated, as has been explained above.

A user may thus place the safety guard in place over the cartridge and then may holster or carry the CEW, and the CEW will be prevented from firing the cartridge. When a user desires to fire the CEW, such as after removing the CEW from a holster, the user may easily manually remove the safety guard by applying a manual force to overcome the pressure of the first biased retainer and second biased retainer of the safety guard which hold the safety guard coupled to the cartridge. The manual force required to remove the safety guard may be adjusted by altering the first and second electrical contacts of the safety guard so that the pressure applied to the first and second electrodes is as desired. The safety guard may accordingly be designed so that the safety guard will not decouple from the cartridge without a user manually applying a force thereto, but also so that the manual force required to remove the safety guard is minimal, such that the safety guard is easily and quickly removed when desired.

The cartridge shown in the drawings is a representative example of one type of cartridge, though the safety guard may be used with any variety of cartridge types and the principles disclosed herein may be used by those of ordinary skill in the art to construct safety guards for a wide variety of cartridge types. The particular cartridge shown includes a button 56 which, when depressed, depresses a retention member 58. The retention member 58 is used to lock the cartridge in place coupled with the CEW, and when the button is depressed the retention member will depress and allow the cartridge to be removed from the CEW. The cartridge shown in the drawings includes two buttons 56 and two corresponding retention members 58, one button and retention member on one side of the cartridge and another button and retention member on an opposite side of the cartridge. Thus a user may manually remove the cartridge from the CEW by depressing both buttons simultaneously and then applying a force to move the cartridge away from the CEW.

A depression 60 borders each button 56. A first depression 62 is shown in the drawings and a second depression, not shown in the drawings, is located on an opposite side of the cartridge bordering the other button. Each depression 60 forms a slot 64, which in the implementations shown is a curved slot 66.

Figure 3:
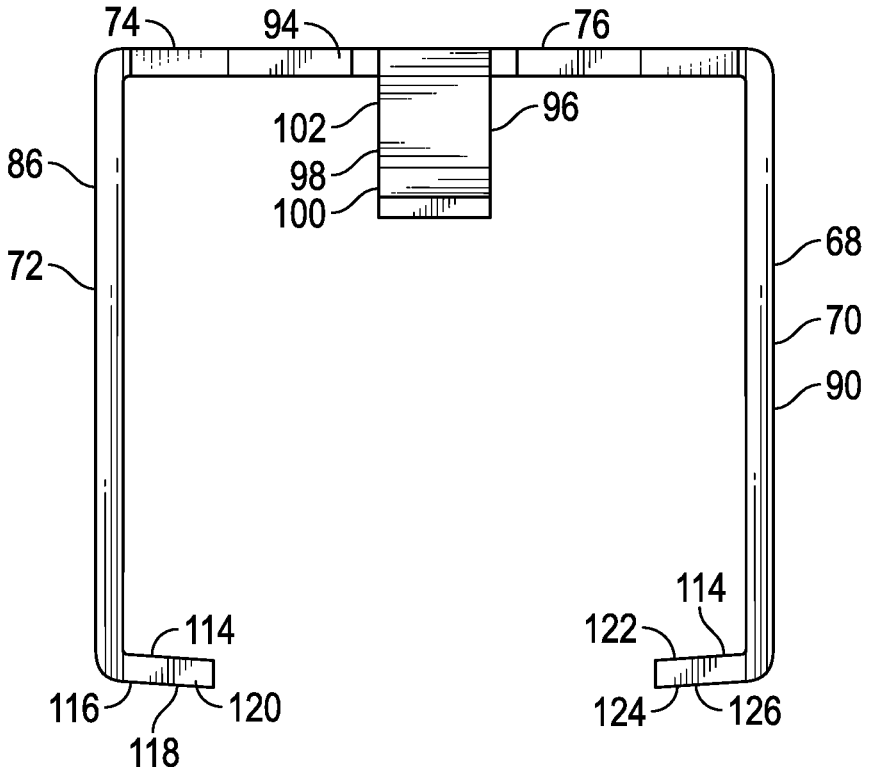
FIG. 3 is a front view of the safety guard of FIG. 1.
Figure 4:
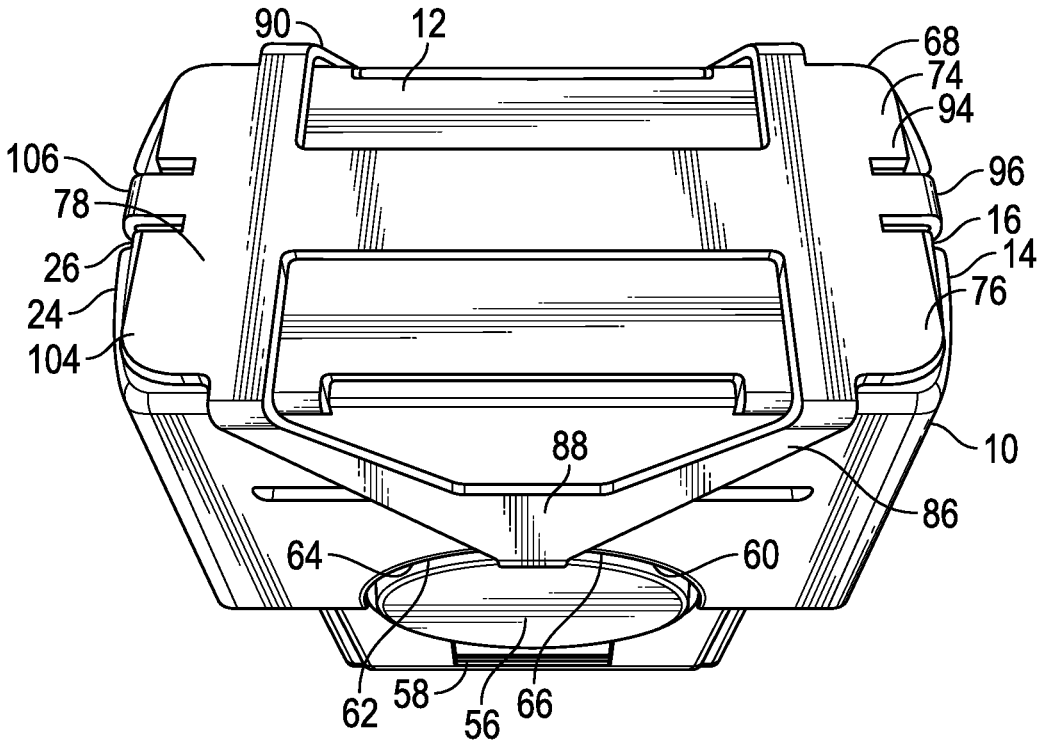
FIG. 4 is a top perspective view of the safety guard of FIG. 1 coupled with an ammunition cartridge (cartridge)

The safety guard 68 in various implementations includes elements to secure it to a cartridge in addition to the first and second biased retainers. By non-limiting example, and referring still to FIGS. 1-8, the first side panel 86 may include a clip 114 and the second side panel 90 may also include a clip 114. The clip 114 of the first side panel is a first clip 116 which includes a first projection 118 in the form of a tab 120. The clip 114 of the second side panel is a second clip 122 which includes a second projection 124 in the form of a tab 126. As seen in FIG. 3, the first projection 118 extends generally away from the first side panel towards the second side panel, and the second projection 124 extends generally away from the second side panel towards the first side panel. In implementations, as shown in the drawings, the first projection and second projection are not exactly parallel with the top panel of the safety guard, but they are offset by a few or by several degrees (which in implementations may be 3 degrees, or about 3 degrees) and are substantially parallel with the top panel of the safety guard and substantially perpendicular with the largest planar surfaces of the side panels. Accordingly, each projection 118 or 124 extends substantially perpendicularly from a largest planar surface of a side panel of the body.

When the safety guard is placed over a cartridge, the first clip 116 inserts into the first depression 62 and the second clip 122 inserts into the second depression. The first clip and second clip thus secure the safety guard to the cartridge in addition to the first and second biased retainers securing the safety guard to the cartridge. Nevertheless, in implementations in which the first and second clips are used, the safety guard may still be easily removed by a user with manual force alone, as has been described above. In implementations a user need not directly remove the clips from the depressions to remove the safety guard from the cartridge, but may provide a manual upwards force on the safety guard to move it away from the cartridge which is sufficient to cause the clips to exit the depressions.

In implementations the first and/or second clip could interact with one or more other depressions of the cartridge instead of those that border the button, and indeed one or more depressions designed specifically to receive the first and/or second clip could be included in a particular cartridge. In various implementations a safety guard could include only one clip, to interact with one corresponding depression, instead of two clips, though as shown in the drawings including two clips, to interact with two corresponding depressions, may allow the safety guard to be more securely coupled with the cartridge than it would be with a single clip. It may be seen from the drawings that each of the clips is located between the first and second electrical contacts, though neither is located directly on a line that would connect the first electrical contact with the second electrical contact. More than two clips may also be used.

Two openings of the safety guard are visible, each being formed partially within the top panel and partially within one of the side panels of the safety guard. These openings are optional, though in implementations including them may reduce material cost by allowing less metal or other material to be used in forming the safety guard, and including the openings and/or adjusting their sizes and shapes in various implementations may allow for tailoring of the force required to remove the safety guard from a cartridge (and place it thereon) by increasing or reducing the rigidity of the side panels relative to the top panel and/or the overall rigidity of the safety guard in general. They may also allow the user to be able to determine the type of cartridge currently inserted into the weapon by observing the color or other identifying features of the cartridge.

Referring to FIG. 7, the CEW, the cartridge and the safety guard together form a safety system 2 for a conductive energy weapon (CEW). When the cartridge is coupled with the CEW and the safety guard is in place over the cartridge, then when a voltage is applied across the first and second electrodes, if the safety guard is contacted with a user's or target's skin or clothing, the user may not be immobilized or negatively affected due to current flowing through the lower resistance safety guard instead of through the higher resistance user or target, or because relatively little current flows through the user due to the majority, or almost all, of the current flowing through the low resistance safety guard between the first and second electrode.

In implementations, in order to further ensure that a user or target is not accidentally immobilized or negatively affected by being (or their clothing being) in contact with the safety guard when the trigger is pulled or firing mechanism is otherwise activated, an electrical insulator 80 may be coupled with the top panel of the safety guard. Referring to FIG. 8, the electrical insulator 80 may include an insulative layer 82 and/or may include an insulative coating 84. The electrical insulator could be, by non-limiting example, a ceramic, plastic, and or rubber coating applied atop the top panel of the body 72, a plastic element coupled or adhered thereto, a non-conductive paint, or any other material that can be coupled with the electrically conductive material of the guard and has electrically insulating properties. The electrical insulator may cover the sides of the first electrical contact and second electrical contact, as shown in FIG. 8, though in other implementations, the electrical insulator may not cover the sides of the first and second electrical contacts. The electrical insulator may, as described herein, prevent an electrical current from passing between the first electrode and the second electrode through a target when the target is coupled with the first electrode and the second electrode only through the electrical insulator. In implementations the safety guard may be safe enough without the use of an electrical insulator so that the electrical insulator may be excluded.

The safety guard 68 may be formed entirely of a conductive metal, such as a steel or other metal, or could include a non-conductive or less-conductive metal but could have a conductive or high-conductive metal at the first and second electrical contacts which couples the first and second electrical contacts together. In various implementations, the body of the safety guard could be formed mostly or entirely of a non-conductive material, such as a polymer or ceramic material, and a conductive undercoating or material could be applied or deposited to the underside or inside of the top panel and inside surfaces of the first and second electrical contacts so that the first electrical contact and second electrical contact are in electrical contact with one another and are able to be in electrical communication with the first and second electrodes, respectively, through the conductive undercoating.

In implementations the slot 64 is a 1.2 mm, or an about 1.2 mm, slot. In implementations each of the side panels (the first side panel and second side panel) has a longest length, perpendicular to the top panel (or in other words perpendicular to the largest planar surface of the top panel), of 32 mm, or of about 32 mm. In implementations the top panel has a longest length, from the first electrical contact to the second electrical contact, along a straight line connecting the two, of 40 mm, or of about 40 mm. In implementations each of the first electrical contact and second electrical contact has a longest length, perpendicular to the top panel (or in other words perpendicular to the largest planar surface of the top panel), of 4 mm, or about 4 mm. In implementations each of the first electrical contact and second electrical contact has a top portion substantially parallel with the largest planar surface 78 that has a length, along a straight line connecting the first electrical contact and second electrical contact, of 4 mm, or of about 4 mm. In implementations each of the first electrical contact and second electrical contact has a width, parallel with the top panel (or in other words parallel with the largest planar surface of the top panel) and perpendicular to a line connecting the first electrical contact with the second electrical contact, of 4 mm, or about 4 mm.

In implementations the top panel has a length, from an uppermost portion of the first side panel to an uppermost portion of the second side panel, along a line perpendicular with a line connecting the first electrical contact with the second electrical contact (or in other words from the outer largest planar surface of the first side panel to the outer largest planar surface of the second side panel), of 35 mm, or about 35 mm. In implementations there is a distance of 33 mm, or about 33 mm, between the inside largest planar surface of the first side panel and the inside largest planar surface of the second side panel. In implementations a length from the inside largest planar surface of the top panel and a top surface of a clip, taken along a line perpendicular with the largest planar surface of the top panel, is 30 mm, or is about 30 mm. In implementations a length from the inside largest planar surface of the top panel and a bottom surface of a clip, taken along a line perpendicular with the largest planar surface of the top panel, is 31 mm, or is about 31 mm.

In implementations each clip forms an angle of 3 degrees, or of about 3 degrees, relative to a largest planar surface of the top panel (and, accordingly, an angle of 93 degrees, or about 93 degrees, with the corresponding side panel from which it projects).

In implementations the entire body 72 is formed of 1 mm thick, or about 1 mm thick, metal, pressed and/or punched to shape. For example a 1 mm, or an about 1 mm, thick steel blank could be punched to form the edges and the openings, and then the punched blank could be pressed to form the bends between the top and side panels, the bends between the side panels and the clips, and the bends of the first and second electrical contacts. A corrosion resistant coating may be applied over every surface of the body, and in implementations may be a military specification (mil-spec) corrosion resistant coating.

In places where the description above refers to particular implementations of safety guards for conductive energy weapon ammunition and related methods and implementing components, sub-components, methods and sub-methods, it should be readily apparent that a number of modifications may be made without departing from the spirit thereof and that these implementations, implementing components, sub-components, methods and sub-methods may be applied to other safety guards for conductive energy weapon ammunition and related methods.

What is claimed is:

1. A safety guard for an ammunition cartridge of a conductive energy weapon (CEW), comprising:

a body configured to be removably coupled with an ammunition cartridge (cartridge), the body comprising:

a first biased retainer comprising a first electrical contact on a first side of the body configured to be in electrical contact with a first electrode of the cartridge;

a second biased retainer comprising a second electrical contact on a second side of the body opposite the first side of the body, the second electrical contact configured to be in electrical communication with the first electrical contact through the body, and the second electrical contact configured to be in electrical contact with a second electrode of the cartridge, and;

at least one clip having a projection configured to be inserted into a corresponding depression of the cartridge.

2. The safety guard of claim 1, wherein a bias of the first biased retainer and a bias of the second biased retainer are configured to be overcome through manual force alone of a user to remove the body from the cartridge.

3. The safety guard of claim 1, wherein the body is configured to prevent a static charge from firing the cartridge when the first electrical contact is in contact with the first electrode and the second electrical contact is in contact with the second electrode.

4. The safety guard of claim 1, wherein the body is configured to prevent a trigger pull of the CEW from discharging a projectile from the cartridge when the first electrical contact is contacting the first electrode and the second electrical contact is contacting the second electrode.

5. The safety guard of claim 1, wherein the body is configured to prevent a trigger pull of the CEW from igniting a squib of the cartridge when the first electrical contact is contacting the first electrode and the second electrical contact is contacting the second electrode.

6. The safety guard of claim 1, further comprising an electrical insulator coupled at a top of the body and configured to substantially prevent an electrical current from passing between the first electrode and the second electrode through a target when the target is coupled with the first electrode and the second electrode only through the electrical insulator.

7. A safety guard for an ammunition cartridge of a conductive energy weapon (CEW), comprising:

a body configured to be removably coupled with an ammunition cartridge (cartridge), the body comprising:

a first biased retainer comprising a first tab forming a first electrical contact on a first side of the body, the first tab configured to be in electrical contact with a first electrode of the cartridge;

a second biased retainer comprising a second tab forming a second electrical contact on a second side of the body opposite the first side of the body, the first tab configured to be in electrical communication with the first electrical contact through the body, and the second tab configured to be in electrical contact with a second electrode of the cartridge; and at least one clip comprising a projection configured to be inserted in a corresponding depression of the cartridge.

8. The safety guard of claim 7, wherein the first tab and the second tab each comprise a curved tab extending substantially perpendicularly from a largest planar surface of a top panel of the body.

9. The safety guard of claim 7, wherein the projection comprises a tab extending substantially perpendicularly from a largest planar surface of a side panel of the body.

10. The safety guard of claim 7, further comprising an electrical insulator coupled at a top of the body and configured to substantially prevent an electrical current from passing between the first electrode and the second electrode through a target when the target is coupled with the first electrode and the second electrode only through the electrical insulator.

11. The safety guard of claim 7, wherein the first biased retainer applies a pressure to the first electrode and the second biased retainer applies a pressure to the second electrode sufficient to retain the body coupled with the cartridge.

12. The safety guard of claim 7, wherein the pressure applied to the first biased retainer and the pressure applied to the second biased retainer are configured to be overcome through manual force alone of a user to remove the body from the cartridge.

13. The safety guard of claim 7, wherein the safety guard is configured to prevent the cartridge from firing due to a static charge.

14. The safety guard of claim 7, wherein the safety guard is configured to prevent the cartridge from firing when the cartridge is inserted into the CEW and a firing input is received by the CEW from a user.

15. The safety guard of claim 7, wherein a majority of the safety guard is comprised of an electrically conductive material.

16. A safety guard for an ammunition cartridge of a conductive energy weapon (CEW), comprising:

a body configured to be removably coupled with an ammunition cartridge (cartridge), the body comprising:

a first biased retainer on a first side of the body configured to be in electrical contact with a first electrode of the cartridge;

a second biased retainer on a second side of the body opposite the first side of the body, the second biased retainer configured to be in electrical communication with the first biased retainer through the body, and the second biased retainer configured to be in electrical contact with a second electrode of the cartridge, and;

at least one clip having a projection configured to be inserted into a corresponding depression of the cartridge.

17. The safety guard of claim 16, wherein a bias of the first biased retainer and a bias of the second biased retainer are configured to be overcome through manual force alone of a user to remove the body from the cartridge.

18. The safety guard of claim 16, wherein the body is configured to prevent a static charge from firing the cartridge when the first biased retainer is in contact with the first electrode of the cartridge and the second biased retainer is in contact with the second electrode of the cartridge.

19. The safety guard of claim 16, wherein the body is configured to prevent a trigger pull of the CEW from discharging a projectile from the cartridge when the first biased retainer is contacting the first electrode and the second biased retainer is contacting the second electrode.

20. The safety guard of claim 16, wherein the body is configured to prevent a trigger pull of the CEW from igniting a squib of the cartridge when the first biased retainer is contacting the first electrode and the second biased retainer is contacting the second electrode.

* * * * *